US009498985B2

(12) United States Patent
Tsuboi

(10) Patent No.: US 9,498,985 B2
(45) Date of Patent: Nov. 22, 2016

(54) LIQUID APPLICATION APPARATUS AND COMPUTER-READABLE STORAGE MEDIUM

(71) Applicant: BROTHER KOGYO KABUSHIKI KAISHA, Nagoya-shi, Aichi-ken (JP)

(72) Inventor: Motohiro Tsuboi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/633,940

(22) Filed: Feb. 27, 2015

(65) Prior Publication Data

US 2015/0246370 A1 Sep. 3, 2015

(30) Foreign Application Priority Data

Feb. 28, 2014 (JP) ..... 2014-039606

(51) Int. Cl.
*B41J 13/02* (2006.01)

(52) U.S. Cl.
CPC ..... *B41J 13/02* (2013.01)

(58) Field of Classification Search
CPC ..... B41J 2/211; B41J 2/2117; B41J 2/2114
See application file for complete search history.

(56) References Cited

U.S. PATENT DOCUMENTS

2004/0207708 A1* 10/2004 Ohashi ..... B41J 13/025 347/104
2007/0252887 A1* 11/2007 Mizuhara ..... B41J 2/325 347/212
2008/0055381 A1* 3/2008 Doi ..... B41J 2/0057 347/103
2013/0050377 A1* 2/2013 Inoue ..... B41J 13/226 347/104

FOREIGN PATENT DOCUMENTS

JP 2010-143014 A 7/2010

* cited by examiner

*Primary Examiner* — Justin Seo
(74) *Attorney, Agent, or Firm* — Merchant & Gould P.C.

(57) ABSTRACT

A liquid application apparatus comprises: a pair of conveyor rollers including two rollers configured to rotate while pinching a recording medium thereby to convey the recording medium in a first direction; a liquid applicator configured to apply a liquid; and a controller configured to control driving of the pair of conveyor rollers and to control the liquid applicator. The controller executes a calculation process of calculating an estimated value of an amount of extraneous matter attached to the pair of conveyor rollers taking into account weighting data indicating a weighting given, based on an amount of paper dust, to each of areas on the recording medium which areas are arranged in a second direction crossing the first direction.

15 Claims, 8 Drawing Sheets

ESTIMATED VALUE OF AMOUNT OF EXTRANEOUS MATTER — EJECTION AMOUNT — COEFFICIENT — FIRST THRESHOLD VALUE

AREA A: $X_A = \sum_{k=1}^{n} k\left\{Y_A\left(= Q_A \times \overbrace{C_a \times C_l \times C_S \times C_p \times C_h}^{\text{COEFFICIENT}}\right)\right\} > T_A1\ ?$

⋮

AREA G: $X_G = \sum_{k=1}^{n} k\left\{Y_G\left(= Q_G \times C_a \times C_l \times C_S \times C_p \times C_h\right)\right\} > T_G1\ ?$

| PAPER SIZE | $C_l$ |
|---|---|
| A4 | 1.0 |
| A3 | 1.2 |
| A5 | 0.7 |
| LETTER | 0.9 |
| ... | ... |

| AREA | $C_s$ |
|---|---|
| D (THIRD AREA) | 1.2 |
| A~C,E~G (FOURTH AREA) | 1.0 |

| PAPER TYPE | $C_p$ |
|---|---|
| PLAIN PAPER | ... |
| HEAVY PAPER | ... |
| GLOSSY PAPER | ... |
| ... | ... |
| ... | ... |

LIQUID APPLICATION APPARATUS AND COMPUTER-READABLE STORAGE MEDIUM

CROSS REFERENCE TO RELATED APPLICATION

The present application claims priority from Japanese Patent Application No. 2014-039606, which was filed on Feb. 28, 2014, the disclosure of which is herein incorporated by reference in its entirety.

BACKGROUND OF THE INVENTION

1. Field of the Invention

The present invention relates to: a liquid application apparatus configured to apply a liquid to a recording medium; and a computer-readable storage medium storing a program for a controller of the liquid application apparatus.

2. Description of Related Art

As an example of a liquid application apparatus, an inkjet recording apparatus has been known. The inkjet recording apparatus may include: a pair of conveyor rollers; and an application roller positioned upstream of the pair of conveyor rollers in a conveyance direction. The application roller applies a liquid supplied on the outer circumferential surface of the application roller to an overall surface of a recording medium, while pinching the recording medium between the application roller and another roller.

In the above-described apparatus, as the recording medium onto which the liquid has been applied is conveyed, the liquid transfers to the pair of conveyor rollers, and in addition, paper dust and the like are attached to the pair of conveyor rollers. This increases the diameters of the rollers constituting the pair of conveyor rollers, possibly causing the deterioration in conveyance accuracy and the resultant deterioration in image quality. In the above-described apparatus, there may be estimated an amount of extraneous matter attached to the pair of conveyor rollers based on: the number of times a recording medium is conveyed; the amount of usage of the liquid; and/or the like.

SUMMARY OF THE INVENTION

The paper dust is not distributed uniformly on a recording medium, but a part of the recording medium may have a larger amount of paper dust. Therefore, even if the possibility that the paper dust is included in the extraneous matter is taken into consideration, it is not possible to accurately grasp the amount of extraneous matter without considering the manner of distribution of the paper dust on a recording medium.

An object of the present invention is to provide a liquid application apparatus and a computer-readable storage medium, in each of which the amount of extraneous matter is accurately grasped.

According to a first aspect of the present invention, there is provided a liquid application apparatus comprising: a pair of conveyor rollers including two rollers configured to rotate while pinching a recording medium thereby to convey the recording medium in a first direction; a liquid applicator configured to apply a liquid; and a controller configured to control driving of the pair of conveyor rollers and to control the liquid applicator. The controller executes a calculation process of calculating an estimated value of an amount of extraneous matter attached to the pair of conveyor rollers taking into account weighting data indicating a weighting given, based on an amount of paper dust, to each of areas on the recording medium which areas are arranged in a second direction crossing the first direction.

According to a second aspect of the present invention, there is provided a computer-readable storage medium storing a program for a controller of a liquid application apparatus. The liquid application apparatus comprises: a pair of conveyor rollers including two rollers configured to rotate while pinching a recording medium thereby to convey the recording medium in a first direction; a liquid applicator configured to apply a liquid; and the controller configured to control driving of the pair of conveyor rollers and to control the liquid applicator. The program causes the controller to execute a calculation process of calculating an estimated value of an amount of extraneous matter attached to the pair of conveyor rollers taking into account weighting data indicating a weighting given, based on an amount of paper dust, to each of areas on the recording medium which areas are arranged in a second direction crossing the first direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe preferred embodiments of the present invention, with reference to the drawings.

First, the overall structure of an inkjet printer 1 of a first embodiment of the present invention will be described, referring to FIG. 1.

Figure 1:
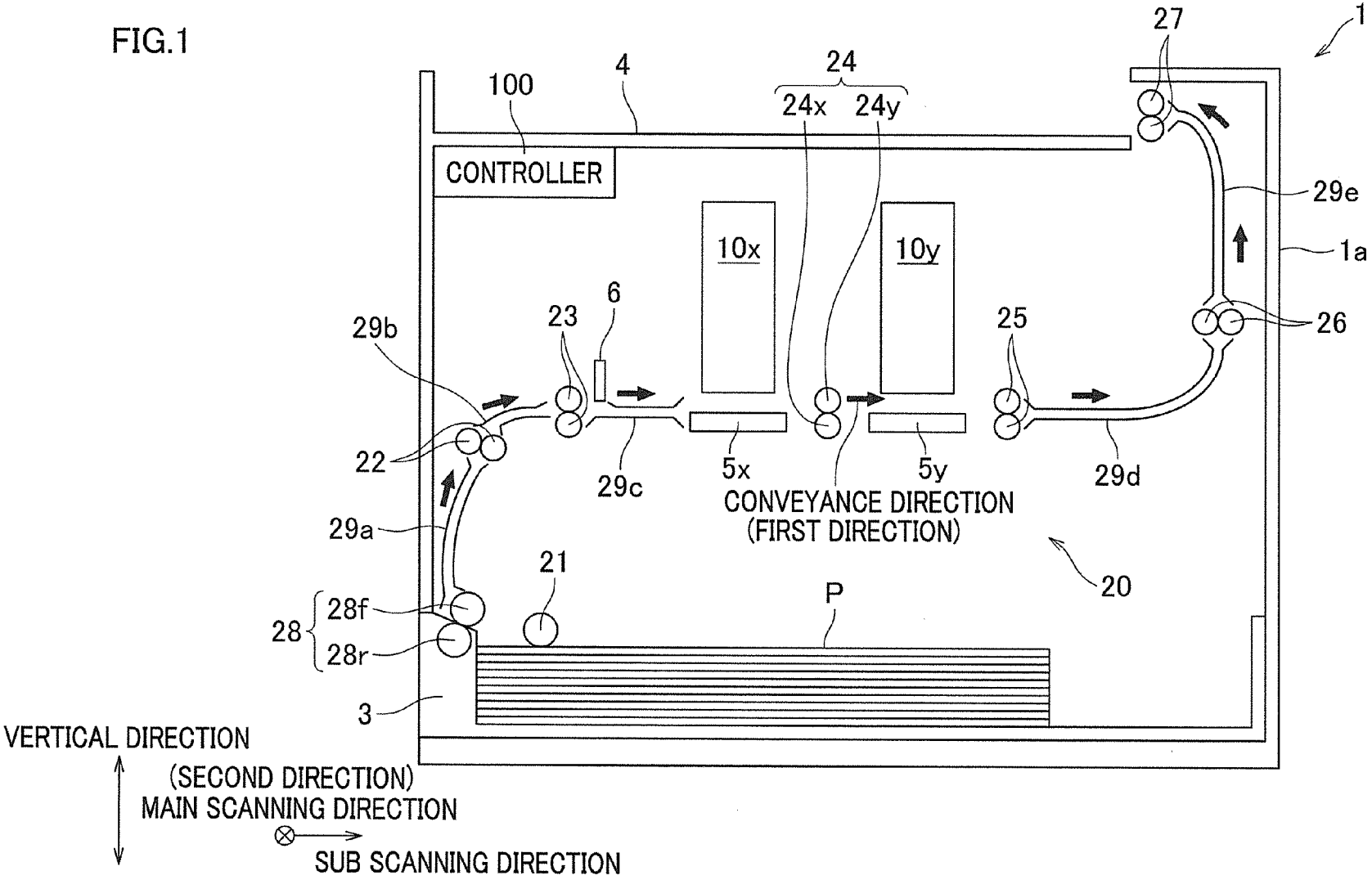
FIG. 1 is a schematic side view of the inside of an inkjet printer of a first embodiment of the present invention.

As shown in FIG. 1, the printer 1 includes: a casing 1*a*, a treatment liquid ejection head 10*x*, an ink ejection head 10*y*, platens 5*x* and 5*y*, a conveyor unit 20, a container 3, a receiver 4, a sheet sensor 6, and a controller 100. The heads 10*x* and 10*y*, the platens 5*x* and 5*y*, the conveyor unit 20, the container 3, the sheet sensor 6, and the controller 100 are provided in the casing 1*a*. The receiver 4 is provided on the top plate of the casing 1*a*.

Figure 2:
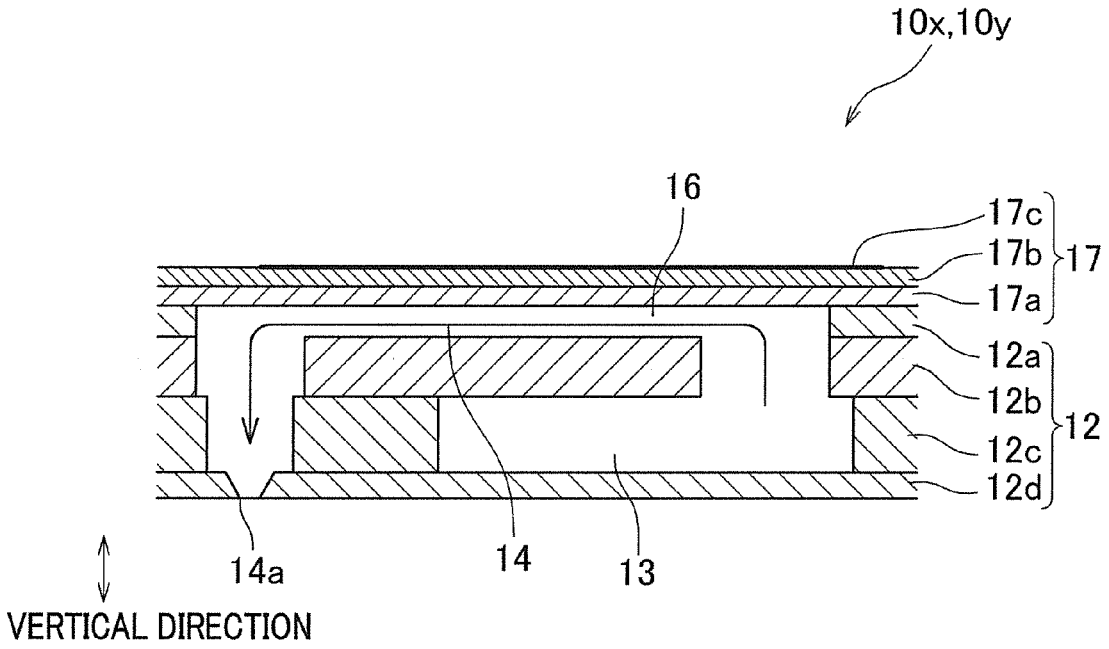
FIG. 2 is a partial sectional view of each of heads included in the printer shown in FIG. 1.

The heads 10*x* and 10*y* have the same structure. Each of the heads 10*x* and 10*y* is a line head of a rectangular parallelepiped shape which is long in a main scanning direction. As shown in FIG. 2, each of the heads 10*x* and 10*y* includes a passage unit 12 and actuator units 17.

The passage unit 12 is a member formed of four plates 12*a*, 12*b*, 12*c*, and 12*d* stacked on one another. The passage unit 12 has passages formed therein, and has a plurality of ejection openings 14*a* opening onto its under surface. Through the ejection openings 14*a*, the heads 10*x* and 10*y* eject a treatment liquid and black ink, respectively. Hereinafter, the treatment liquid and the black ink may be collectively referred to as a "liquid". The treatment liquid is a liquid having a function of preventing bleed and/or bleed-through of ink by aggregating the pigments in the ink, a function of improving the color reproduction and/or the quick drying property of the ink, and/or the like. The treatment liquid may contain a cationic polymer or a polyvalent metal salt such as a magnesium salt. The passages formed inside the passage unit 12 include a single manifold channel 13 and a plurality of individual passages 14. The individual passages 14 are provided for the ejection openings 14*a*, respectively, and each individual passage 14 extends from a corresponding exit of the manifold channel 13 to a corresponding ejection opening 14*a* via a corresponding pressure chamber 16. The manifold channel 13 communicates with a not-illustrated tank storing the liquid. The liquid supplied from the tank to the manifold channel 13 passes through the individual passages 14, to be ejected from the ejection openings 14*a*.

Each actuator unit 17 is a member in which a diaphragm 17*a*, a piezoelectric layer 17*b*, and a plurality of individual electrodes 17*c* are stacked. The diaphragm 17*a* is fixed on the top surface of the passage unit 12, and covers the pressure chambers 16. The piezoelectric layer 17*b* is fixed on the top surface of the diaphragm 17*a*, and opposes the pressure chambers 16. The individual electrodes 17*c* are fixed on the top surface of the piezoelectric layer 17*b*, and respectively oppose the pressure chambers 16. The portion of the actuator unit 17 which is sandwiched by each individual electrode 17*c* and the corresponding pressure chamber 16 functions as a unimorph actuator exclusive to that pressure chamber 16, and the actuator is capable of independently deforming in response to the application of the voltage to the individual electrode 17*c* associated therewith. As the actuator is deformed so as to protrude toward the pressure chamber 16, the capacity of the pressure chamber 16 is decreased. Thereby a pressure is applied to the liquid in the pressure chamber 16, so that the liquid is ejected through the ejection opening 14*a*. Thus, by selectively applying the voltage to the individual electrodes 17*c*, the liquid is selectively ejected from the ejection openings 14*a* of each of the heads 10*x* and 10*y*. That is, each of the heads 10*x* and 10*y* is configured to apply the liquid to a part of a sheet P with respect to the main scanning direction.

As shown in FIG. 1, the platens 5*x* and 5*y* are respectively provided for the heads 10*x* and 10*y*, and respectively positioned below the corresponding heads 10*x* and 10*y*. Between the top surfaces of the platens 5*x* and 5*y* and the under surfaces of the respective heads 10*x* and 10*y*, there are formed predetermined spaces suitable for recording.

The conveyor unit 20 is configured to convey a sheet P from the container 3 to the receiver 4 via the spaces between the heads 10*x* and 10*y* and the platens 5*x* and 5*y*. The conveyor unit 20 includes a pickup roller 21, a pair of separation rollers 28, pairs of conveyor rollers 22 to 27, and guides 29*a* to 29*e*.

Figure 4:
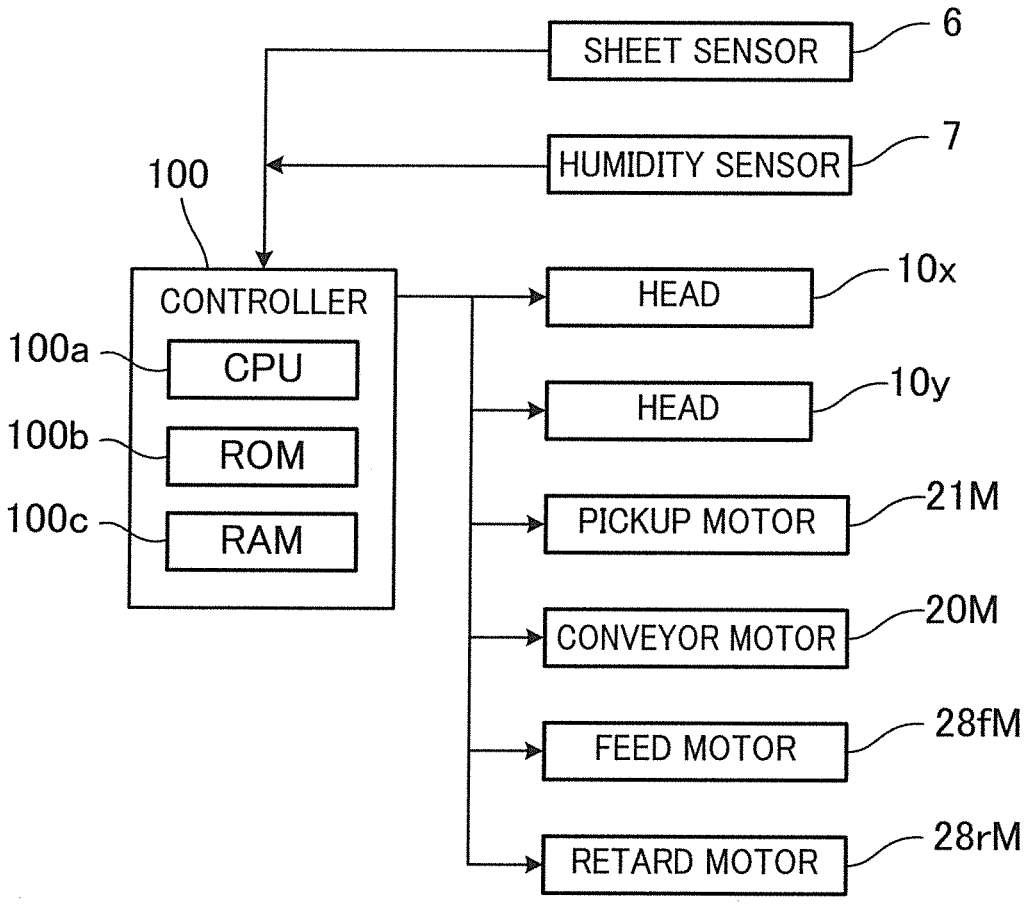
FIG. 4 is a block diagram showing the electric configuration of the printer shown in FIG. 1.

The pickup roller 21 is positioned so as to come into contact with the topmost sheet P of sheets P in the container 3. The pickup roller 21 is rotated by a pickup motor 21M (see FIG. 4) which is driven under the control of the controller 100. As the pickup roller 21 is rotated, the topmost sheet P of the sheets P in the container 3 is sent out from the container 3. That is, the pickup roller 21 is configured to forward each of the sheets P stored in the container 3 toward the pairs of conveyor rollers 22 to 27.

Figure 3:
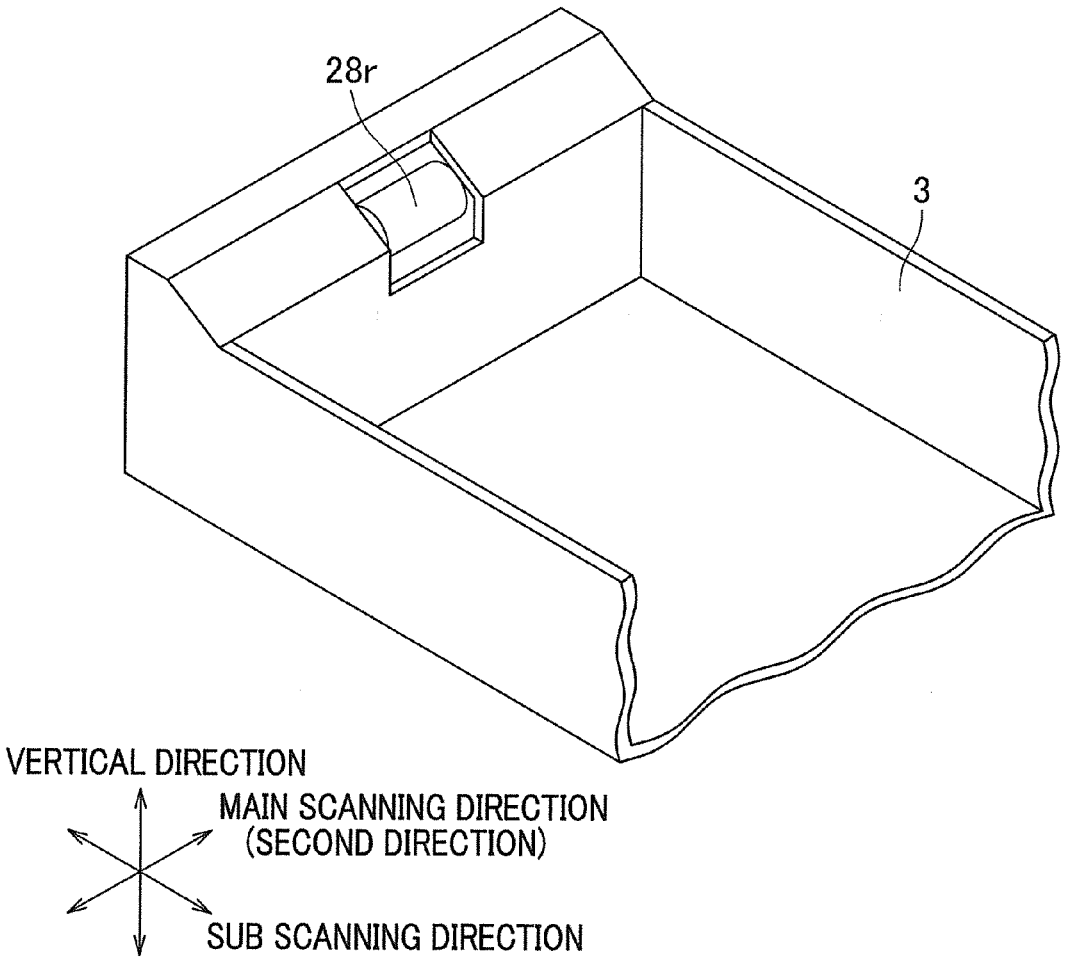
FIG. 3 is a partial perspective view of a container, showing a retard roller included in the printer shown in FIG. 1.

The pair of separation rollers 28 are configured to separate a plurality of sheets P simultaneously forwarded by the pickup roller 21, by applying a frictional resistance to the sheets P. The pair of separation rollers 28 include a feed roller 28*f* and a retard roller 28*r*. The retard roller 28*r* is held by a side wall of the container 3 (see FIG. 3). The feed roller 28*f* is rotated clockwise in FIG. 1 by a feed motor 28*f*M (see FIG. 4) which is driven under the control of the controller 100. The retard roller 28*r* is rotated by a retard motor 28*r*M (see FIG. 4) which is driven under the control of the controller 100. The retard roller 28*r* has a torque limiter. The retard roller 28*r* rotates counterclockwise in FIG. 1 with the feed roller 28*f* when one sheet P is pinched by the retard roller 28*r* and the feed roller 28*f*. Meanwhile, the retard roller 28 rotates clockwise in FIG. 1 when a plurality of sheets P are pinched by the retard roller 28*r* and the feed roller 28*f*. Therefore, when a plurality of sheets P are forwarded by the pickup roller 21, the topmost sheet P of the sheets P is separated from the other sheet(s) P, to be forwarded to the pairs of conveyor rollers 22 to 27. Thus, these rollers prevent simultaneous conveyance of a plurality of sheets P.

Each pair of conveyor rollers (22 to 27) include two rollers contacting each other, and are configured to convey a sheet P while pinching the sheet P by the two rollers. One of the two rollers constituting each pair of conveyor rollers (22 to 27) is a driving roller rotated by a corresponding conveyor motor 20M (see FIG. 4) which is driven under the control of the controller 100. The other of the two rollers constituting each pair of conveyor rollers (22 to 27) is a driven roller which rotates with the rotation of the driving roller in the direction opposite to that of the driving roller, while contacting the driving roller. As the pairs of conveyor rollers 22 to 27 rotate, a sheet P sent out from the container 3 by the pickup roller 21 is conveyed toward the receiver 4 via the spaces below the heads 10*x* and 10*y*.

Each of the guides 29*a* to 29*e* is configured to define a conveyance path for a sheet P, and each guide includes a pair of plates provided apart from each other with a space therebetween.

The container 3 is a tray having an open top. The container 3 is attachable to and detachable from the casing 1*a* in a sub scanning direction. The container 3 is capable of storing a plurality of sheets P, which can be of different sizes. The receiver 4 is also capable of receiving a plurality of sheets P, which can be of different sizes.

The sub scanning direction is parallel to a horizontal surface. The main scanning direction (a second direction) is parallel to the horizontal surface and orthogonal to the sub scanning direction. A vertical direction is orthogonal to the sub scanning direction and to the main scanning direction. Although the direction in which a sheet P is conveyed by the conveyor unit 20 varies as the sheet P is conveyed, the conveyance direction in which the sheet P is conveyed by the pairs of the conveyor rollers 23 to 25 below the heads 10*x* and 10*y* (a first direction) is parallel to the sub scanning direction. Hereinafter, this direction is simply referred to as the "conveyance direction". The conveyance direction is from the left to the right in FIG. 1.

The controller 100 includes: a CPU (central processing unit) 100*a*, a ROM (read only memory) 100*b*, a RAM (random access memory including non-volatile RAM) 100*c*, an ASIC (application specific integrated circuit), an I/F (interface), an I/O (input/output port), and the like. The ROM 100*b* stores programs executed by the CPU 100*a*, various fixed data including later-described weighting data, and the like. The RAM 100*c* temporarily stores data required for executing a program. The ASIC conducts operations such as rewriting and reordering of image data (e.g., signal processing and image processing). The I/F exchanges data with an external apparatus (e.g., a personal computer connected to the printer 1). The I/O conducts input/output of detection signals of various sensors.

In this embodiment, attention is focused on the pair of conveyor rollers 24, and estimated is the amount of extraneous matter attached to the pair of conveyor rollers 24. As described above, the pair of conveyor rollers 24 are a part of the conveyor unit 20. The pair of conveyor rollers 24 are provided downstream of the treatment liquid ejection head 10*x* in the conveyance direction, and upstream of the ink ejection head 10*y* in the conveyance direction. The heads 10*x* and 10*y* respectively correspond to a treatment liquid ejector and a recording liquid ejector of the present invention. Further, the heads 10*x* and 10*y* correspond to a liquid applicator of the present invention.

Now, description will be given for: how the extraneous matter is attached to the pair of conveyor rollers 24; and harmful effects brought by the extraneous matter. A sheet P forwarded from the container 3 passes through the space between the head 10*x* and the platen 5*x*. At this time, the liquid is ejected from the ejection openings 14*a* selected from all the ejection openings 14*a* as the ejection openings from which the liquid should be ejected, and thereby the liquid is applied to the sheet P. When the sheet P is conveyed further downstream in the conveyance direction, a portion of the sheet P on which the liquid has been applied is pinched by the pair of conveyor rollers 24. Then, the liquid applied to the sheet P is attached to an upper roller 24*y*, which is in an upper position out of two rollers 24*x* and 24*y* constituting the pair of conveyor rollers 24. After the trailing end of the sheet P passes over the pair of conveyor rollers 24, the liquid attached to the upper roller 24*y* transfers the lower roller 24*x*, which is in a lower position out of the rollers 24*x* and 24*y*. This way, the liquid is attached to the rollers 24*x* and 24*y* in the course of the conveyance, by the pair of conveyor rollers 24, of the sheet P onto which the liquid has been applied. Further, not only the above-described liquid having been applied to the sheet P, but also mist from the ejection openings 14*a* of each of the heads 10*x* and 10*y*, paper dust from the sheet P, and the like can be attached to the rollers 24*x* and 24*y*. Therefore, the liquid and the paper dust are mixed together on the outer circumferential surfaces of the rollers 24*x* and 24*y*, and attached to the surfaces, thereby increasing the diameters of the rollers 24*x* and 24*y*. The increase in the diameters of the rollers 24*x* and 24*y* lowers the accuracy of conveyance ("conveyance accuracy"). Particularly, the increase in the diameter of the lower roller 24*x* which is the driving roller increases the speed of conveyance, and this lowers the conveyance accuracy.

Figure 5:
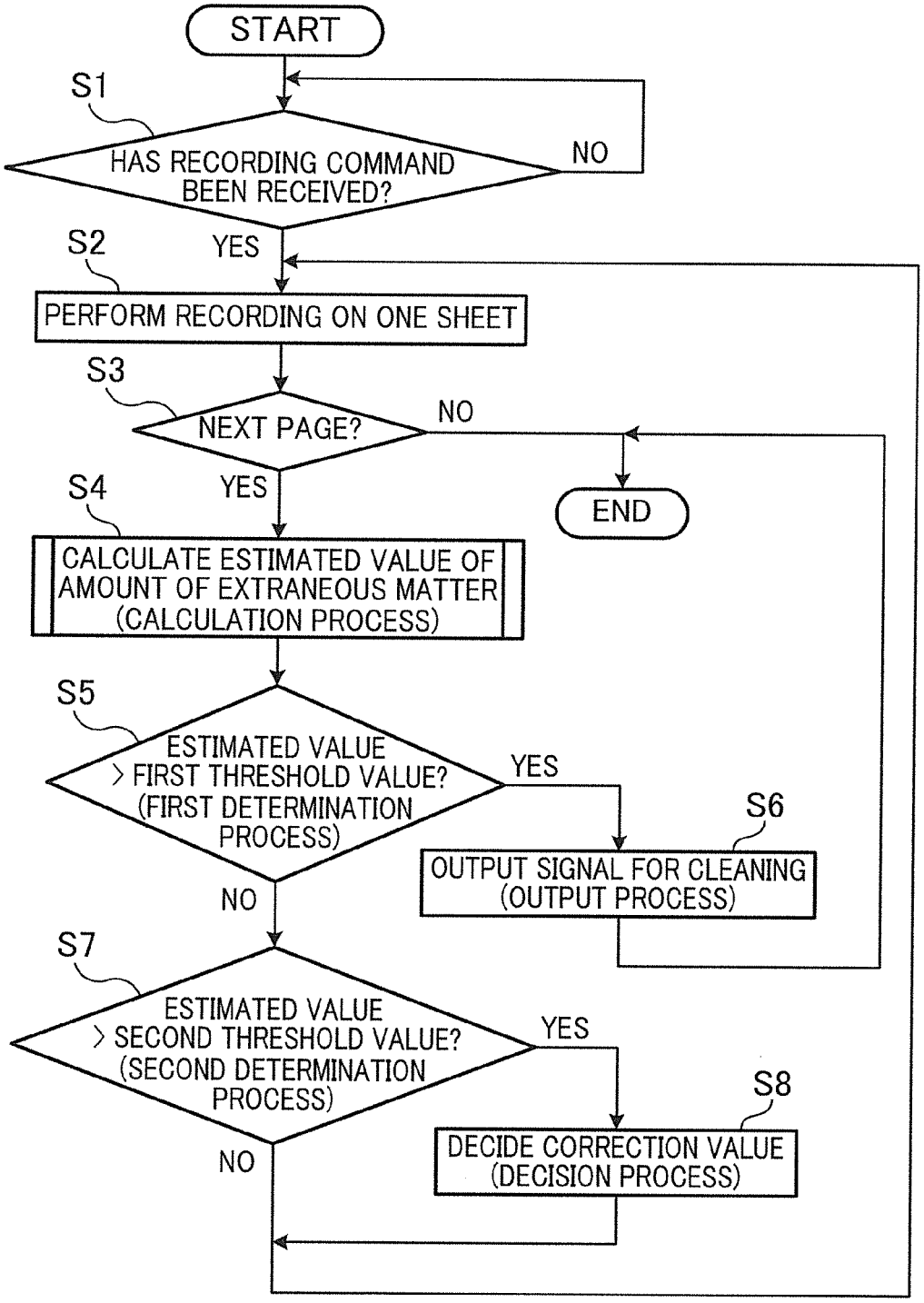
FIG. 5 is a flowchart showing the control executed by a controller of the printer shown in FIG. 1.

Now, the control executed by the controller 100 will be described, with reference to FIG. 5 and other figures. While the printer 1 is powered on, the controller 100 repeatedly executes the routine shown in FIG. 5.

First, the controller 100 determines whether a recording command has been received from an external apparatus (S1). When the recording command has not been received (S1: NO), the controller 100 repeats the processing of S1. When the recording command has been received (S1: YES), the controller 100 controls the parts so that recording is performed on a sheet P (S2). In S2, the controller 100 controls the pickup motor 21M, the feed motor 28*f*M, the retard motor 28*r*M, and the conveyor motors 20M, to convey the topmost sheet P of sheets P in the container 3, and the controller 100 controls the heads 10*x* and 10*y* based on a signal from the sheet sensor 6 so that the liquid is ejected on the sheet P. With this, recording is performed on the sheet P.

After S2, the controller 100 determines whether to perform recording on the next sheet P, referring to the received recording command (S3). When recording is not performed on the next sheet P (S3: NO), the controller 100 ends this routine. When recording is performed on the next sheet P (S3: YES), the controller 100 calculates an estimated value of the amount of extraneous matter (S4: calculation process). Note that the amount of the extraneous matter is the amount of the extraneous matter attached to the pair of conveyor rollers 24.

Figure 7:
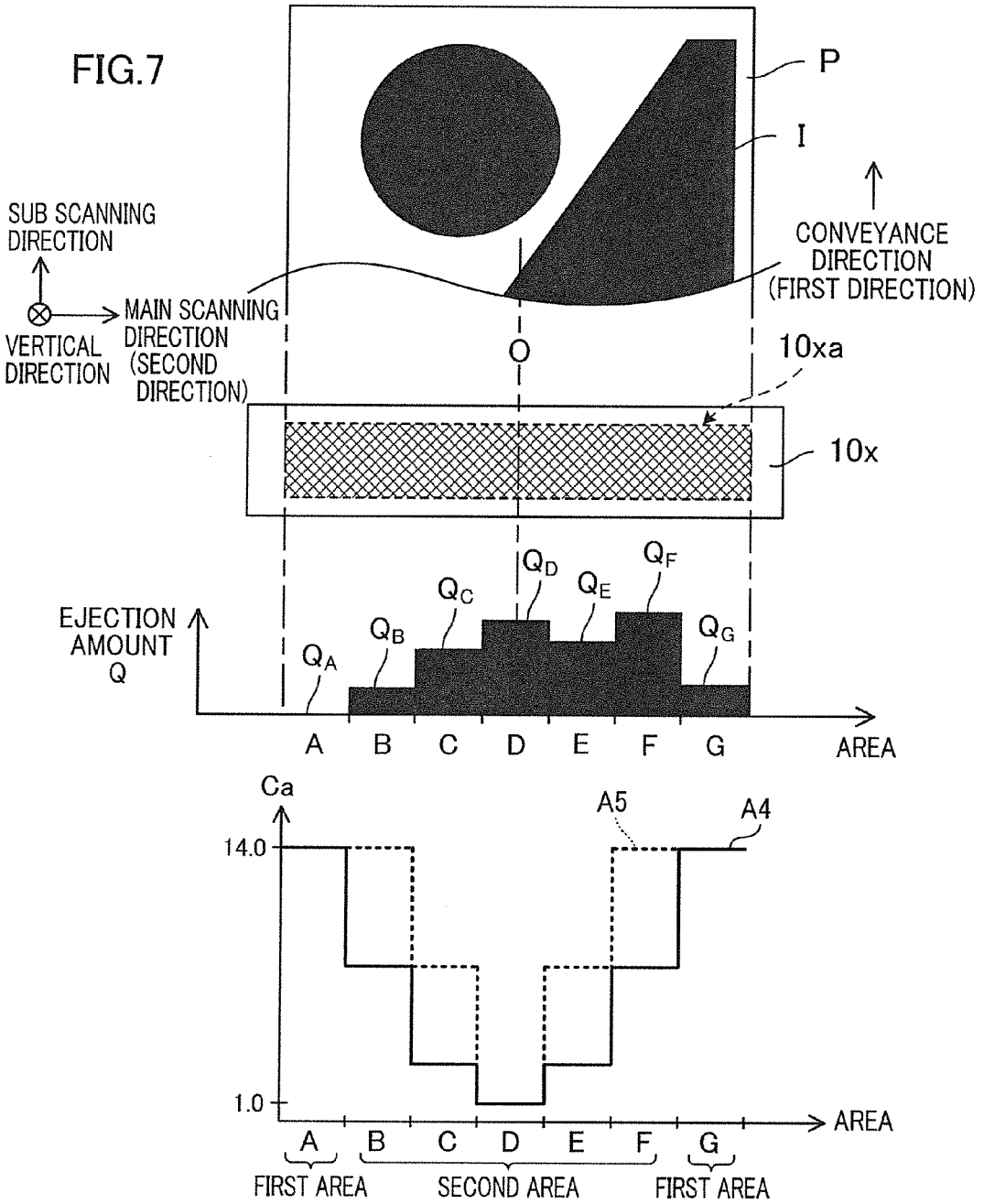
FIG. 7 is an explanatory diagram for explaining the process of S4 (the calculation process) shown in FIG. 5.

In S4, the controller 100 calculates the estimated value of the amount of the extraneous matter based on: the amounts of the liquid applied by the treatment liquid ejection head 10*x* to seven areas A to G during the formation of an image I on the sheet P (ejection amounts $Q_A$ to $Q_G$); and weighting data (coefficients $C_a$, $C_l$, $C_s$, and the like), as shown in FIG. 7. The seven areas A to G are on a sheet P and arranged in the main scanning direction. In other words, the seven areas A to G are defined depending on the width of the sheet P (i.e., the length of the sheet P in the main scanning direction). The seven areas A to G are obtained by dividing the whole area on the sheet P into seven parts equally with respect to the width of the sheet P from one end to the other end in the main scanning direction. Each of the areas A to G extends from the leading end to the trailing end of the sheet P in the conveyance direction. Out of the areas A to G, the areas A and G correspond to a first area of the present invention, and the areas A and G respectively include the ends of the sheet P in the main scanning direction. The areas B to F correspond to a second area of the present invention, and the areas B to F do not include any of the ends of the sheet P in the main scanning direction. The area D includes a center O which is the center of the sheet P in the main scanning direction. The ejection amounts $Q_A$ to $Q_G$ are the total amounts of the treatment liquid ejected to the respective areas A to G on one sheet P from the ejection openings 14*a* disposed in an area 10*xa* of the treatment liquid ejection head 10*x*, the area 10*xa* overlapping the sheet P with respect to the main scanning direction.

In this embodiment, the controller 100 calculates, in S4, the estimated value of the amount of the extraneous matter ($X_A$ to $X_G$) for each of the areas A to G. That is, the estimated values $X_A$ to $X_G$ are respectively specific to and respectively correspond to the areas A to G.

Figure 6:
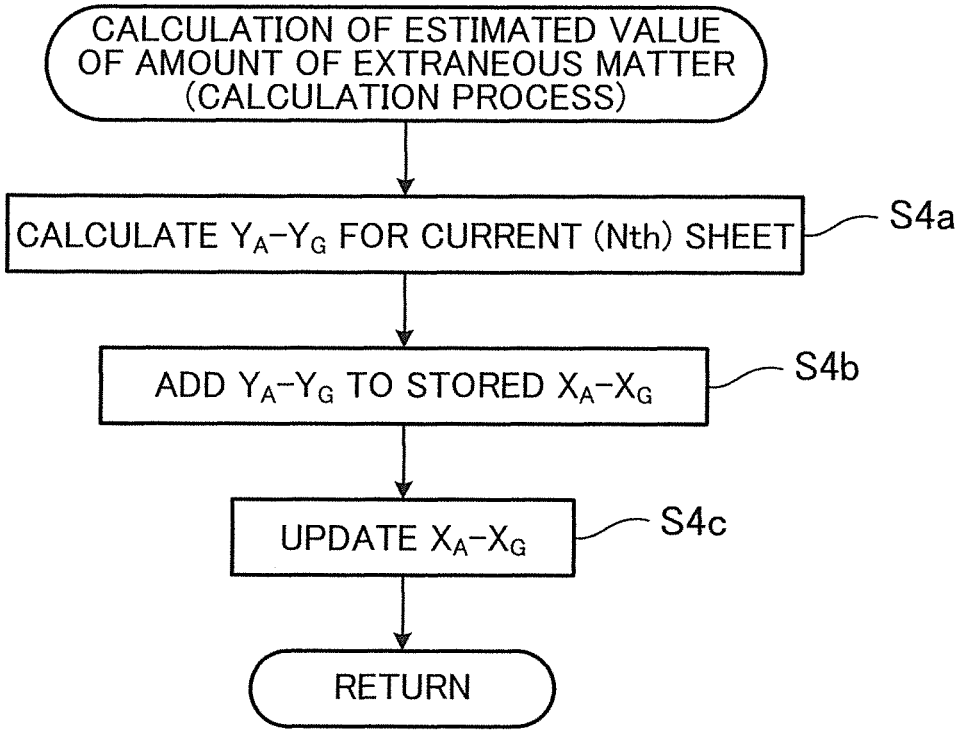
FIG. 6 is a flowchart elaborating S4 (a calculation process) shown in FIG. 5.

Specifically, S4 is executed as follows. As shown in FIG. 6, the controller 100 first calculates values $Y_A$ to $Y_G$ indicating the estimated amounts of the extraneous matter attached to the pair of conveyor rollers 24 because of recording on the Nth sheet P onto which recording has been performed in the current routine (that is, in the last S2 prior to the current S4) (S4*a*). The values $Y_A$ to $Y_G$ are calculated for each sheet P. After S4*a*, the controller 100 reads out, from the RAM 100*c*, the estimated values $X_A$ to $X_G$ (the estimated values calculated in the previous S4 executed before the current S4). Each estimated value is the accumulation of the values calculated for the first to the (N−1)th sheets P. When N=1, the controller reads out the initial value i.e., zero. Then, the controller adds the values $Y_A$ to $Y_G$ calculated in S4*a* to the read-out values (S4*b*). After S4*b*, the controller 100 stores, in the RAM 100*c*, the values obtained through the addition in S4*b* (the estimated values each of which is the accumulation of the values for the first to the Nth sheets P), as new estimated values $X_A$ to $X_G$. In other words, the controller updates the estimated values $X_A$ to $X_G$ stored in the RAM 100*c* (S4*c*).

Thus, in this embodiment, each estimated value ($X_A$ to $X_G$) is obtained by: calculating the corresponding value per sheet ($Y_A$ to $Y_G$) by multiplying the corresponding ejection amount ($Q_A$ to $Q_G$) by the coefficients $C_a$, $C_l$, $C_s$, $C_p$, and $C_h$; and summing up the thus obtained values per sheet ($Y_A$ to $Y_G$) correspondingly to the number of the sheets P. It should be noted that each of the coefficients $C_l$, $C_p$, and $C_h$ is a value for each sheet P (i.e., each of these coefficients does not vary depending on the area (the seven areas A to G on one sheet P)), while each of the coefficients $C_a$ and $C_s$ and the ejection amount ($Q_A$ to $Q_G$) is a value for each sheet P and can vary depending on the area (the areas A to G).

The value of the coefficient $C_a$ is determined for each of the areas A to G based on the amount of paper dust generated from a sheet P. As shown in FIG. 7, the values of the coefficient $C_a$ are determined so that the value of the area closer to each end of the sheet P in the main scanning direction is larger than the value of the area including the center O. Specifically, the value of the area D is the smallest ($C_a$=1.0), and the value of the areas A and G is the largest ($C_a$=14.0). The values of the coefficient $C_a$ may be arbitrarily determined. For example, the values of the coefficient $C_a$ may be determined based on the relationship between the areas A to G and the amount of paper dust, i.e., based on the distribution manner of the paper dust, obtained through experiments in the manufacturing process of the printer 1. The values of the coefficient $C_a$ for the areas A and G may be larger than the value of the coefficient $C_a$ for the area D (for example, the values of the coefficient $C_a$ for the areas A and G may be not less than twice, preferably not less than five times, more preferably not less than ten times the value of the coefficient $C_a$ for the area D). The ROM 100*b* stores therein a plurality of sets of data of the coefficient $C_a$ respectively for sheets P in different sizes, that is, for sheets P of which lengths in the main scanning direction are different from one another. In FIG. 7, there are illustrated the sets of data respectively for an A4 size sheet and an A5 size sheet. In this embodiment, the values of the coefficient $C_a$ for the areas B, C, E, and F of an A5-size sheet are different from those of an A4-size sheet. Based on data indicating the paper size and included in the recording command, the controller 100 reads out, from the ROM 100*b*, the set of data of the coefficient $C_a$ corresponding to that paper size, and the controller 100 uses the read out data in S4.

Figures 8A, 8B, 8C, 8D:
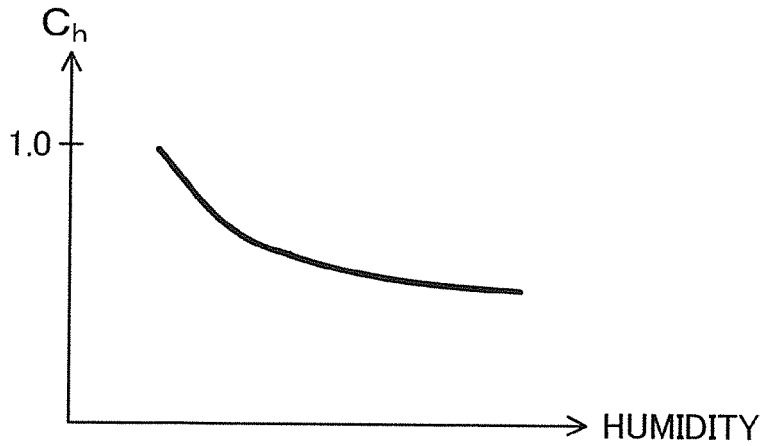
FIGS. 8A to 8D are explanatory diagrams for respectively explaining coefficients $C_l$, $C_s$, $C_p$, and $C_h$ shown in FIG. 7.

As shown in FIG. 8A, the value of the coefficient $C_l$ is determined for each of the sizes of the sheets P (A4, A3, A5, letter, and the like) so that the longer the length of a sheet P in the conveyance direction, the larger the value is. The values of the coefficient $C_l$ may be arbitrarily determined. For example, the values of the coefficient $C_l$ may be determined based on the relationship between the length of the sheet P in the conveyance direction and the amount of paper dust, which relationship is obtained through experiments in the manufacturing process of the printer 1. Information on the coefficient $C_l$ is stored in the ROM 100*b*. Based on the data indicating the paper size and included in the recording command, the controller 100 reads out, from the ROM 100*b*, the value of the coefficient $C_l$ corresponding to that paper size, and the controller 100 uses the read out data in S4.

As shown in FIG. 8B, the value of the coefficient $C_s$ is determined for each of the areas A to G. In this embodiment, the pair of separation rollers 28 are provided. The areas A to G include: a third area which comes into contact with the pair of separation rollers 28 (for example, the area D); and a fourth area which does not come into contact with the pair of separation rollers 28 (for example, the areas A to C and E to G). It would be appear that there is a larger amount of paper dust in the third area than in the fourth area because of the influence of the friction against the pair of separation rollers 28. Therefore, in this embodiment, the coefficient $C_s$ set so that the weighting value of the third area ($C_s$=1.2) is larger than the weighting value of the fourth area ($C_s$=1.0) is used as the weighting data related to the pair of separation rollers 28. The values of the coefficient $C_s$ may be arbitrarily determined. For example, the values of the coefficient $C_s$ may be determined based on the relationship between the position of the pair of separation rollers 28 and the amount of paper dust, which relationship is obtained through experiments in the manufacturing process of the printer 1. Information on the coefficient $C_s$ is stored in the ROM 100*b*.

As shown in FIG. 8C, the value of the coefficient $C_p$ is determined for each of the paper types such as plain paper, heavy paper, glossy paper, and the like. For example, the thicker the sheet is the larger the value of the coefficient $C_p$ is. As well, the value of the coefficient $C_p$ is larger for the paper on which surface treatment has been performed, e.g., for surface gloss. The thicker a sheet P is, the more firmly the sheet P is pressed onto the upper roller 24*y* when pinched by the pair of conveyor rollers 24. Therefore, it is more likely that the liquid applied to the sheet P transfers to the upper roller 24*y*. Accordingly, there is a tendency that the thicker the sheet P is, the larger amount of liquid is attached to the pair of conveyor rollers 24. Meanwhile, on a surface-treated sheet P such as glossy paper, the liquid applied to the sheet P is more likely to be retained on the surface of the sheet P, and the liquid is less likely to be absorbed by the sheet P, compared with a plain sheet P. Therefore, the liquid applied to the treated sheet P is more likely to transfer to the upper roller 24*y*. Accordingly, there is a tendency that a larger amount of liquid is attached to the pair of conveyor rollers 24 on a surface-treated sheet P. As shown in FIG. 8D, the coefficient $C_h$ is determined as a function of humidity. The higher the humidity is, the smaller the value of the coefficient $C_h$ is. Information on the coefficients $C_p$ and $C_h$ is stored in the ROM 100*b*. Based on data indicating the paper type and included in the recording command, the controller 100 reads out, from the ROM 100*b*, the corresponding value of the coefficient $C_p$. Further, based on a signal from a humidity sensor 7 (see FIG. 4) provided in the casing 1*a*, the controller 100 reads out, from the ROM 100*b*, the corresponding value of the coefficient $C_h$. Then, the controller 100 uses these read out values in S4.

The ejection amounts $Q_A$ to $Q_G$ are the amounts of the treatment liquid ejected by the treatment liquid ejection head 10*x* to the areas A to G, respectively. In this embodiment, the amounts of the treatment liquid ejected by the treatment liquid ejection head 10*x* are based on ejection data according to which the ink ejection head 10*y* ejects ink. Specifically, based on the image data included in the recording command, the controller 100 generates the ejection data according to which the ink ejection head 10*y* ejects ink. Then, without separately preparing the ejection data according to which the treatment liquid ejection head 10*x* ejects the treatment liquid based on the image data, the controller 100 controls the driving of the heads 10*x* and 10*y* based on the ejection data according to which the ink ejection head 10*y* ejects ink.

The ejection data is provided for each of the ejection openings 14*a* and for each pixel. The ejection data indicates the amount of the liquid which should be ejected from each ejection opening 14*a*. Pixels are components constituting an image I formed on a sheet P. The pixels are arranged in a matrix correspondingly to image formation areas on the sheet P. In this embodiment, the number of tones is four. The ROM 100*b* stores therein four types of ejection data respectively corresponding to the levels of the amount of the liquid for forming one pixel, which are "zero", "small", "medium", and "large". One of the four types of ejection data is allocated to each ejection opening 14*a*. In the ink ejection head 10*y*, ink of which amount is the same as the amount indicated by the ejection data is ejected from each ejection opening 14*a*. In the treatment liquid ejection head 10*x*, the treatment liquid is not ejected from each ejection opening 14*a* to which the ejection data indicating to the level of "zero" or "small" is allocated, but the treatment liquid of the "medium" level is ejected from each ejection opening 14*a* to which the ejection data indicating the level of "medium" or "large" is allocated.

After the pair of conveyor rollers 24 are cleaned up, the estimated values $X_A$ to $X_G$ are reset to the initial value i.e., zero. That is, the estimated values $X_A$ to $X_G$ are accumulation of the respective values $Y_A$ to $Y_G$ for the sheets P which have passed between the pair of conveyor rollers 24 since the completion of the manufacture of the printer 1 or since the last time the pair of conveyor rollers 24 are cleaned up. With the reset of the estimated values $X_A$ to $X_G$, the number of recorded sheets N is also reset to the initial value i.e., zero.

After S4, the controller 100 determines whether the estimated values $X_A$ to $X_G$ calculated in S4 respectively exceed first threshold values $T_A$1 to $T_G$1 (S5: a first determination process). Specifically, in S5, the controller 100 reads out the estimated values $X_A$ to $X_G$ from the RAM 100*c*, and determines whether the read-out estimated values $X_A$ to $X_G$ respectively exceed the first threshold values $T_A$1 to $T_G$1. The first threshold values $T_A$1 to $T_G$1 respectively correspond to the areas A to G (to the estimated values $X_A$ to $X_G$). The first threshold values $T_A$1 to $T_G$1 may be the same as one another, or may be different from one another.

In this embodiment, the controller 100 determines, in S5, whether at least one of the estimated values $X_A$ to $X_G$ exceeds the corresponding one of the first threshold values $T_A$1 to $T_G$1.

When at least one of the estimated values $X_A$ to $X_G$ exceeds the corresponding one of the first threshold values $T_A$1 to $T_G$1 (S5: YES), the controller 100 outputs a signal for cleaning of the pair of conveyor rollers 24 (S6: an output process). In this embodiment, the controller 100 gives, in S6, a notification on the cleaning of the pair of conveyor rollers 24 to a user of the printer 1 through an output unit of the printer 1, such as a display, a speaker, and the like. After S6, the controller 100 ends this routine.

The pair of conveyor rollers 24 may be cleaned up in various ways. For example, the pair of conveyor rollers 24 may be cleaned up by a sheet P for cleaning provided by the user in the container 3 and conveyed by the conveyor unit 20. Alternatively, the user may clean up the pair of conveyor rollers 24 by wiping out the extraneous matter on the pair of conveyor rollers 24 using a member for cleaning, such as sponge. When the controller 100 detects the completion of the cleaning of the pair of conveyor rollers 24 after S6, the controller 100 resets the estimated values $X_A$ to $X_G$ stored in the RAM 100*c* to the initial value i.e., zero. Further, the controller 100 resets the number of recorded sheets of N to the initial value i.e., zero. The controller 100 may detect the completion of the cleaning of the pair of conveyor rollers 24 through a signal indicating the completion of the cleaning inputted into the printer 1 by the user after the cleaning of the pair of conveyor rollers 24, for example. The user may input the signal to the printer 1 through an external apparatus or an input unit of the printer 1 such as an input button. Alternatively, the controller 100 may detect the completion of the cleaning of the pair of conveyor rollers 24 based on a signal from a detection unit such as a sensor which is provided to the printer 1 and is configured to detect whether the pair of conveyor rollers 24 have been cleaned up. For example, in the printer 1 including an openable and closable cover for covering the pair of conveyor rollers 24, there may be provided a detection unit configured to detect that the cover is open (that is, the cover is open with the result that the pair of conveyor rollers 24 are exposed); and the controller 100 may detect the completion of the cleaning of the pair of conveyor rollers 24 when the controller 100 receives, from the detection unit, a signal indicating that the cover is open.

When none of the estimated values $X_A$ to $X_G$ exceed the corresponding first threshold values $T_A$1 to $T_G$1 (S5: NO), the controller 100 determines whether the estimated values $X_A$ to $X_G$ calculated in S4 respectively exceed second threshold values $T_A$2 to $T_G$2 (S7: a second determination process). Similarly to the first threshold value $T_A$1 to $T_G$1, the second threshold values $T_A$2 to $T_G$2 respectively correspond to the areas A to G (to the estimated values $X_A$ to $X_G$). The second threshold values $T_A$2 to $T_G$2 may be the same as one another, or may be different from one another. Further, in this embodiment, the second threshold values $T_A$2 to $T_G$2 are respectively smaller than the corresponding first threshold values $T_A$1 to $T_G$1.

In this embodiment, the controller 100 determines, in S7, whether at least one of the estimated values $X_A$ to $X_G$ exceeds the corresponding one of the second threshold values $T_A$2 to $T_G$2.

Note that the threshold values $T_A$1 to $T_G$1 and $T_A$2 to $T_G$2 are stored in the ROM 100*b*. For example, in the manufacturing process of the printer 1, the values at which disturbance in a printed image (deviation of the landing position of the liquid on a sheet P) is visually checked in test recording may be stored in the ROM 100*b* as the threshold values $T_A$1 to $T_G$1 and $T_A$2 to $T_G$2. In this embodiment, depending on the degree of the disturbance in the printed image, the threshold values corresponding to relatively low degree of disturbance may be defined as the second threshold values $T_A$2 to $T_G$2, and the threshold values corresponding to relatively high degree of disturbance may be defined as the first threshold values $T_A$1 to $T_G$1.

When none of the estimated values $X_A$ to $X_G$ exceed the corresponding second threshold values $T_A$2 to $T_G$2 (S7: NO), the controller 100 returns the processing to S2. On the other hand, when at least one of the estimated values $X_A$ to $X_G$ exceeds the corresponding one of the second threshold values $T_A$2 to $T_G$2 (S7: YES), the controller 100 decides a correction value using which the rotation rate of the pair of conveyor rollers 24 is corrected, based on the estimated values $X_A$ to $X_G$ calculated in S4 (S8: a decision process). The ROM 100*b* stores therein a table indicating the association between the estimated values and the correction values. In S8, the controller 100 decides the correction value to be used, by checking the estimated values $X_A$ to $X_G$ calculated in S4 against the above table. The correction values may be arbitrarily decided. For example, the correction values may be decided based on: the relationship between the diameters of the rollers 24*x* and 24*y* and the conveyance speed; and the relationship between the amount of extraneous matter attached to the pair of conveyor rollers 24 and the conveyance speed, which relationships are obtained through experiments in the manufacturing process of the printer 1. After S8, the controller 100 returns the processing to S2. In S2 executed after S8, the controller 100 performs recording onto a sheet P while controlling the driving of the pair of conveyor rollers 24 based on the correction value obtained in S8.

As described above, in this embodiment, the estimated values of the amount of the extraneous matter are calculated in S4 (the calculation process), taking into account the weighting data (the coefficient $C_a$) indicating the weighting given to each of the areas A to G based on the amounts of paper dust. With this, the amount of extraneous matter is accurately grasped. Further, appropriate processes (cleaning of the pair of conveyor rollers 24, correction on the conveyance, and the like) are carried out based on the above estimated values, and this more reliably suppresses the deterioration in conveyance accuracy and the resulting deterioration in image quality. Furthermore, in a structure where the pair of conveyor rollers 24 are cleaned up based on the estimated values, poor accuracy in the estimated values leads to an excessively high/low frequency of cleaning. If the cleaning frequency is too high, problems such as wear of the pair of conveyor rollers 24, a lot of user's work, and high cost may be caused. If the cleaning frequency is too low, problems such as deterioration in conveyance accuracy and the resulting deterioration in image quality may be caused. However, the estimated values with high accuracy are obtained in this embodiment, and therefore the above-described problems are reduced.

The printer 1 includes the ROM 100*b* which stores therein the weighting data (the coefficient $C_a$, $C_l$, $C_s$ and the like). With this structure, the calculation process is executed more rapidly than in the case where the weighting data is read out from a storage of an external apparatus.

As shown in FIG. 7, the weighting data (the coefficient $C_a$) is set so that the value of the weighting of the areas A and G (the first area) which respectively include the ends of a sheet P in the main scanning direction is larger than the value of the weighting of the areas B to F (the second area). Out of the areas on a sheet P, the two areas respectively include the ends of the sheet P in the main scanning direction have a larger amount of paper dust than the areas each of which does not include any of these ends. A sheet P is formed by cutting a piece of paper. Therefore, the areas respectively include these ends of the sheet P have a larger amount of paper dust generated by cutting the paper. As a result, in these areas, the amount of paper dust is larger than in the areas each of which does not include any of these ends. The above setting has been made in view of this tendency, and this increases the accuracy of the calculation of the estimated values.

As shown in FIG. 7, the weighting data (the coefficient $C_a$) is set so that the value of the weighting of each of the areas A and G (the first area) is not less than twice the value of the weighting of the area D (the area including the center O which is the center of a sheet P in the main scanning direction). With this structure, the estimated values with higher accuracy are obtained more reliably.

As shown in FIG. 8B, the weighting data (the coefficient $C_s$) is set so that the value of the weighting of the area D (the third area) is larger than the value of the weighting of the areas A to C and E to G (the fourth area). Among the areas on a sheet P, the area coming into contact with the pair of separation rollers 28 has a larger amount of paper dust than the areas which do not come into contact with the pair of separation rollers 28, because of the effect of the friction against the pair of separation rollers 28. The above setting has been made in view of this tendency, and this increases the accuracy of the calculation of the estimated values.

As shown in FIG. 7, the ROM 100*b* stores therein a plurality of sets of data of the coefficient $C_a$ respectively for sheets P of which lengths in the main scanning direction are different from one another. The controller 100 executes S4 (the calculation process) taking into account one of the sets of data of the coefficient $C_a$ read out from the ROM 100*b*. This structure increases the accuracy of the calculation of the estimated values.

As shown in FIG. 8A, the weighting data (the coefficient $C_l$) is set so that the longer the length of a sheet P in the conveyance direction is, the larger the value of the weighting is. The longer the length of a sheet P in the conveyance direction is, the longer the period of time for which the sheet P contacts the pair of conveyor rollers 24, and it is more likely that a larger amount of extraneous matter is attached. The above setting has been made in view of this tendency, and this increases the accuracy of the calculation of the estimated values.

The controller 100 outputs the signal for cleaning of the pair of conveyor rollers 24 (S6: the output process) when the controller 100 determines, in S5 (the first determination process), that the estimated values $X_A$ to $X_G$ exceed the first threshold values $T_A$1 to $T_G$1 (S5: YES). With this structure, the pair of conveyor rollers 24 are cleaned up in response to the processing of S6 (the output process), and therefore, the deterioration in conveyance accuracy and the resulting deterioration in image quality are more reliably suppressed.

The controller 100 calculates the estimated values $X_A$ to $X_G$ respectively corresponding to the areas A to G in S4 (the calculation process), and the controller 100 executes S6 (the output process) when determining, in S5 (the first determination process), that at least one of the estimated values $X_A$ to $X_G$ exceeds the corresponding one of the first threshold values $T_A$1 to $T_G$1 (S5: YES). With this structure, the deterioration in conveyance accuracy and the resulting deterioration in image quality are suppressed further more reliably.

The controller 100 further executes S8 (the decision process) of deciding the correction value using which the rotation rate of the pair of conveyor rollers 24 is corrected, based on the estimated values $X_A$ to $X_G$ calculated in S4. With this structure, the rotation rate of the pair of conveyor rollers 24 is corrected based on the correction value, and thereby the deterioration in conveyance accuracy and the resulting deterioration in image quality are suppressed more reliably.

The controller 100 further executes S7 (the second determination process) of determining whether the estimated values $X_A$ to $X_G$ calculated in S4 exceed the second threshold values $T_A$2 to $T_G$2, and the controller 100 executes S8 (the decision process) when determining that the estimated values $X_A$ to $X_G$ exceed the second threshold values $T_A$2 to $T_G$2 (S7: YES). With the above structure, the correction value is decided at an appropriate timing, and thereby, the deterioration in conveyance accuracy and the resulting deterioration in image quality are suppressed while the simplified control is achieved.

The controller 100 executes S6 (the output process) when determining that the estimated values $X_A$ to $X_G$ exceed the first threshold values $T_A$1 to $T_G$1 (S5: YES). Meanwhile, the controller 100 executes S7 (the second determination process) of determining whether the estimated values $X_A$ to $X_G$ exceed the second threshold values $T_A$2 to $T_G$2 (<the first threshold values $T_A$1 to $T_G$1) when determining that the estimated values $X_A$ to $X_G$ do not exceed the first threshold values $T_A$1 to $T_G$1 (S5: NO). Then, the controller 100 executes S8 (the decision process) when determining that the estimated values $X_A$ to $X_G$ exceed the second threshold values $T_A$2 to $T_G$2 (<the first threshold values $T_A$1 to $T_G$1) (S7: YES). With this structure, the determinations of S5 and S7 and the processes of S6 and S8 are carried out step by step. (That is, when the amount of the extraneous matter is relatively large, cleaning of the pair of conveyor rollers 24 is carried out. Meanwhile, when the amount of the extraneous matter is relatively small, correction on the conveyance is carried out without cleaning the pair of conveyor rollers 24.) Thereby, the deterioration in conveyance accuracy and the resulting deterioration in image quality are suppressed while the frequency of cleaning is reduced.

The ink ejection head 10*y* is positioned downstream of the pair of conveyor rollers 24 in the conveyance direction. When the pair of conveyor rollers 24 are positioned upstream of the ink ejection head 10*y* in the conveyance direction as above, a nip roller may be adopted as the pair of conveyor rollers 24 to ensure the conveyance accuracy of sheets P. The nip roller has a larger contact area with a sheet P than a spur roller, and therefore it is more likely that the liquid transfers from the sheet P to the roller. Thus, the present invention is particularly effective in such a structure. Further, when the pair of conveyor rollers 24 are positioned upstream of the ink ejection head 10*y* in the conveyance direction as above, mist and the like from the ink ejection head 10*y* are possibly attached to the pair of conveyor rollers 24. In the present invention, the amount of the extraneous matter thus attached to the pair of conveyor rollers 24 is calculated in S4 (the calculation process) with high accuracy.

The treatment liquid ejection head 10*x* is positioned upstream of the pair of conveyor rollers 24 in the conveyance direction. When the pair of conveyor rollers 24 are positioned downstream of the treatment liquid ejection head 10*x* in the conveyance direction as above, the treatment liquid applied to a sheet P and mist and the like from the treatment liquid head 10*x* are possibly attached to the pair of conveyor rollers 24. In the present invention, the amount of the extraneous matter thus attached to the pair of conveyor rollers 24 is calculated in S4 (the calculation process) with high accuracy.

The following will describe an inkjet printer of a second embodiment of the present invention.

The printer of the second embodiment has the same structure as the printer 1 of the first embodiment except the processing of S4 (the calculation process) executed by the controller 100. In the first embodiment, to estimate the amount of the extraneous matter attached to the pair of conveyor rollers 24, attention is focused on the liquid applied to a sheet P by the treatment liquid ejection head 10*x* positioned upstream of the pair of conveyor rollers 24 in the conveyance direction, and the controller 100 executes S4 using the amounts of the liquid (the ejection amounts $Q_A$ to $Q_G$) applied to the respective areas A to G by the treatment liquid ejection head 10*x*. To the contrary, in the second embodiment, to estimate the amount of the extraneous matter attached to the pair of conveyor rollers 24, attention is focused on the mist from the ink ejection head 10*y* positioned downstream of the pair of conveyor rollers 24 in the conveyance direction, and the controller 100 executes S4 using an ejection amount Q which is a predetermined value common among all the areas A to G, instead of the ejection amounts $Q_A$ to $Q_G$ for each sheet P and for the respective areas A to G. The value of the ejection amount Q is stored in the ROM 100*b*.

In the second embodiment, the structures similar to those of the first embodiment provide advantageous effects similar to those of the first embodiment.

The pair of conveyor rollers may be positioned upstream of, or downstream of, the liquid applicator in the first direction. Any one of the two rollers constituting the pair of conveyor rollers may be the driving roller. Either one or both of the two rollers constituting the pair of conveyor rollers may include a plurality of unit rollers positioned apart from one another in the second direction.

The separation member is not limited to the pair of separation rollers including the feed roller and the retard roller. The separation member may have another structure as long as it is configured to separate a plurality of recording media forwarded by a supply roller by applying a frictional resistance to the recording media. For example, the separation member may be constituted by a single plate configured to apply a frictional resistance to the recording media. The separation member may be omitted.

The number of the areas is not particularly limited as long as there are a plurality of areas. Further, the length of each area in the second direction is not particularly limited. For example, the lengths of the areas in the second direction may be different from one another. In the calculation process of the first embodiment, the controller does not have to use the ejection data according to which the recording liquid ejector ejects the recording liquid. The controller may use the ejection data according to which the treatment liquid ejector ejects the treatment liquid. The controller may use a coefficient related to a temperature in the calculation process. Further, except the coefficient $C_a$ (the weighting data indicating the weighting given to each of the areas based on the amount of paper dust), the coefficient(s) used in the calculation process may be arbitrarily determined. Other coefficients than the coefficient $C_a$ do not have to be used. When a liquid application apparatus includes the separation member, the weighting data does not have to be set so that the value of weighting of the third area is larger than the value of the weighting of the fourth area. For example, the coefficient $C_s$ may be omitted in the first embodiment. The storage do not have to store therein the plurality of sets of weighting data respectively for recording media of which lengths in the second direction are different from one another. For example, in the first embodiment, instead of storing the sets of data of the coefficient $C_a$ respectively for an A4 size sheet and an A5 size sheet, the ROM 100*b* may store therein a set of data of the coefficient $C_a$ common among sheets in all sizes. In the above-described embodiments, the storage stores therein the plurality of sets of weighting data depending on "the size of the recording medium", as the plurality of sets of weighting data respectively for the recording media of which lengths in the second direction are different from one another. However, instead of this or in addition to this, the storage may store therein a plurality of sets of weighting data depending on "the orientation in which a recording medium is conveyed (hereinafter, referred to as a "conveyance orientation")". Specifically, there is a difference in the length in the second direction between a recording medium conveyed in a portrait orientation (in which the longitudinal direction of the recording medium matches the conveyance direction) and a recording medium conveyed in a landscape orientation (in which the lateral direction of the recording medium matches the conveyance direction), even though these recording media have the same size. Therefore, the storage may store sets of weighting data depending on the conveyance orientation in combination with the size of a recording medium. For example, the storage may store therein a set of weighting data for an A4 size sheet in the portrait orientation and a set of weighting data for an A4 size sheet in the landscape orientation. The storage may store therein a plurality of sets of weighting data respectively for a plurality of combinations of the "size" and the "conveyance orientation" of a recording medium, and the controller may read out one of the sets of weighting data from the storage referring to the both of the "size" and the "conveyance orientation" of a recording medium, to execute the calculation process. The sets of weighting data respectively corresponding to the combinations of the "size" and the "conveyance orientation" of a recording medium are determined based on both of the length of the recording medium in the first direction and the length of the recording medium in the second direction. The weighting data does not have to be set so that the longer the length of the recording medium in the first direction is, the larger the value of the weighting is. For example, the coefficient $C_l$ may be omitted in the first embodiment. The calculation executed by the controller in the calculation process is not limited to the calculation of the plurality of estimated values respectively corresponding to the plurality of areas, that is, the estimated value for each of the areas does not have to be calculated. The controller may calculate an estimated value for the whole areas. For example, in the above-described embodiments, the estimated values $X_A$ to $X_G$ are respectively specific to and respectively correspond to the areas A to G; however, the controller may obtain an estimated value X which is the estimated value for the whole areas A to G by: multiplying the ejection amount $Q(=Q_A+Q_B \ldots +Q_G)$ by the coefficients $C_a$, $C_l$, $C_s$, $C_p$, and $C_h$ to obtain each value Y; and summing up the thus obtained values Y depending on the number of sheets P. The determination made by the controller in the first determination process is not limited to the determination whether at least one of the estimated values calculated in the calculation process exceeds the corresponding one of the first threshold values. The controller may determine whether all the estimated values calculated in the calculation process exceed the respective first threshold values. The first and second threshold values do not have to be determined for each of the areas. Each of the first and second threshold values may be a value common among the plurality of areas. Further, the second threshold value does not have to be smaller than the first threshold value. The second threshold value may be equal to or larger than the first threshold value. In the above-described embodiment, the controller executes the first and second determination processes; however, the controller may execute one of the determination processes, and then execute the output process or the decision process when the controller determines that the estimated value exceeds the threshold value. The first and second determination processes may be omitted. The controller may execute the decision process at an arbitrary timing after the calculation process. That is, in the above-described embodiments, the controller executes the decision process after the controller determines that the estimated values do not exceed the first threshold values (S5: NO) and after the controller determines that the estimated values exceed the second threshold values (S7: YES). However, the present invention is not limited to this. For example, after determining that the estimated values do not exceed the first threshold values (S5: NO), the controller may execute the decision process skipping S7 (the second determination process). In an alternative case where the controller executes one of the determination processes as described above, the controller may execute the decision process after determining that the estimated value exceeds the threshold value, without executing the output process. Alternatively, regardless of the presence or absence of the determination processes and their results, the controller may execute the decision process based on the estimated value calculated in the calculation process. The decision process may be omitted. The cleaning of the pair of conveyor rollers performed in response to the output process does not have to be performed by a user. A cleaning mechanism included in the liquid application apparatus may clean up the pair of conveyor rollers. The output process may be omitted. For example, the controller may stop the recording operation without executing the output process when the controller determines that the estimated value exceeds the first threshold value in the first determination process.

The liquid applicator may eject the liquid, or may apply the liquid. For example, the liquid applicator may be configured to apply a liquid held on the outer circumferential surface of a roller. The liquid applicator may include the recording liquid ejector without including the treatment liquid ejector. The liquid applicator may be positioned upstream of or downstream of the pair of conveyor rollers in the first direction.

The recording medium is not limited to a sheet of paper. The recording medium may be any medium onto which recording is possible. The present invention is not limited to an apparatus including a line-type unit, but is applicable to an apparatus including a serial-type unit. The present invention is not limited to a printer, but is applicable to a facsimile machine, a photocopier, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid application apparatus comprising:

a pair of conveyor rollers including two rollers configured to rotate while pinching a recording medium thereby to convey the recording medium in a first direction;

a liquid applicator configured to apply a liquid; and a controller configured to control driving of the pair of conveyor rollers and to control the liquid applicator; wherein the controller executes a calculation process of calculating an estimated value of an amount of extraneous matter attached to the pair of conveyor rollers taking into account weighting data indicating a weighting given, based on an amount of paper dust, to each of areas on the recording medium which areas are arranged in a second direction crossing the first direction.

2. The liquid application apparatus according to claim 1, further comprising a storage configured to store the weighting data, wherein the controller executes the calculation process taking into account the weighting data read out from the storage.

3. The liquid application apparatus according to claim 1, wherein:

the areas include two first areas which respectively include ends of the recording medium in the second direction, and a second area which does not include the ends; and the weighting data is set so that values of the weightings of the two first areas are larger than a value of the weighting of the second area.

4. The liquid application apparatus according to claim 3, wherein:

the second area includes a center of the recording medium in the second direction; and the weighting data is set so that the values of the weightings of the two first areas are not less than twice the value of the weighting of the second area.

5. The liquid application apparatus according to claim 1, further comprising:

a container configured to store one or more recording media;

a supply roller configured to forward a recording medium stored in the container to the pair of conveyor rollers; and a separation member configured to separate a plurality of recording media forwarded by the supply roller by applying a frictional resistance to the recording media, wherein:

the areas include a third area which comes into contact with the separation member, and a fourth area which does not come into contact with the separation member; and the weighting data is set so that a value of the weighting of the third area is larger than a value of the weighting of the fourth area.

6. The liquid application apparatus according to claim 1, further comprising a storage configured to store a plurality of sets of the weighting data respectively for recording media of which lengths in the second direction are different from one another, wherein the controller executes the calculation process taking into account one of the plurality of sets of the weighting data read out from the storage.

7. The liquid application apparatus according to claim 1, wherein the weighting data is set so that the longer the length of the recording medium in the first direction is, the larger a value of the weighting is.

8. The liquid application apparatus according to claim 1, wherein the controller further executes:

a first determination process of determining whether the estimated value calculated in the calculation process exceeds a first threshold value; and an output process of outputting a signal for cleaning of the pair of conveyor rollers when the controller determines that the estimated value exceeds the first threshold value in the first determination process.

9. The liquid application apparatus according to claim 8, wherein:

in the calculation process, the controller calculates the estimated value for each of the areas;

in the first determination process, the controller determines whether at least one of the estimated values calculated in the calculation process exceeds the first threshold value; and the controller executes the output process when the controller determines that at least one of the estimated values exceeds the first threshold values in the first determination process.

10. The liquid application apparatus according to claim 1, wherein the controller further executes a decision process of deciding a correction value using which rotation rate of the pair of conveyor rollers is corrected, based on the estimated value calculated in the calculation process.

11. The liquid application apparatus according to claim 10, wherein:

the controller further executes a second determination process of determining whether the estimated value calculated in the calculation process exceeds a second threshold value; and the controller executes the decision process when the controller determines that the estimated value exceeds the second threshold value in the second determination process.

12. The liquid application apparatus according to claim 1, wherein the controller further executes:

a first determination process of determining whether the estimated value calculated in the calculation process exceeds a first threshold value;

an output process of outputting a signal for cleaning of the pair of conveyor rollers when the controller determines that the estimated value exceeds the first threshold value in the first determination process;

a second determination process of determining whether the estimated value calculated in the calculation process exceeds a second threshold value which is smaller than the first threshold value when the controller determines that the estimated value does not exceed the first threshold value in the first determination process; and a decision process of deciding a correction value using which rotation rate of the pair of conveyor rollers is corrected, based on the estimated value calculated in the calculation process when the controller determines that the estimated value exceeds the second threshold value in the second determination process.

13. The liquid application apparatus according to claim 1, wherein the liquid applicator includes a recording liquid ejector positioned downstream of the pair of conveyor rollers in the first direction, the recording liquid ejector configured to eject a recording liquid.

14. The liquid application apparatus according to claim 1, wherein the liquid applicator includes a treatment liquid ejector positioned upstream of the pair of conveyor rollers in the first direction, the treatment liquid ejector configured to eject a treatment liquid which reacts with a recording liquid to aggregate or precipitate a component of the recording liquid.

15. A non-transitory computer-readable storage medium storing a program for a controller of a liquid application apparatus, the liquid application apparatus comprising: a pair of conveyor rollers including two rollers configured to rotate while pinching a recording medium thereby to convey the recording medium in a first direction; a liquid applicator configured to apply a liquid; and the controller configured to control driving of the pair of conveyor rollers and to control the liquid applicator, the program causing the controller to execute a calculation process of calculating an estimated value of an amount of extraneous matter attached to the pair of conveyor rollers taking into account weighting data indicating a weighting given, based on an amount of paper dust, to each of areas on the recording medium which areas are arranged in a second direction crossing the first direction.

* * * * *